US008015911B2

(12) United States Patent
Hellstrøm et al.

(10) Patent No.: US 8,015,911 B2
(45) Date of Patent: Sep. 13, 2011

(54) ELECTRONIC FIRING RATE CONTROLLER FOR REMOTE OPERATION OF AN AUTOMATIC FIRING WEAPON

(75) Inventors: Johannes Hellstrøm, Kongsberg (NO); Pål Andersen, Kongsberg (NO)

(73) Assignee: Kongsberg Defence & Aerospace AS, Kongsberg (NO)

( * ) Notice: Subject to any disclaimer, the term of this patent is extended or adjusted under 35 U.S.C. 154(b) by 57 days.

(21) Appl. No.: 12/355,461

(22) Filed: Jan. 16, 2009

(65) Prior Publication Data

US 2011/0197749 A1 Aug. 18, 2011

(51) Int. Cl.
*F41A 19/64* (2006.01)

(52) U.S. Cl. ..... 89/135

(58) Field of Classification Search ..... 89/129.01, 89/129.02, 130, 131, 135, 136, 28.05, 28.1, 89/28.2

See application file for complete search history.

(56) References Cited

U.S. PATENT DOCUMENTS

| | | | | | |
|---|---|---|---|---|---|
| 2,737,652 | A | * | 3/1956 | White et al. | 342/97 |
| 2,831,402 | A | * | 4/1958 | Taslitt | 89/28.05 |
| 3,217,601 | A | | 11/1965 | Gardner | |
| 3,440,926 | A | * | 4/1969 | Gura et al. | 89/135 |
| 3,451,307 | A | | 6/1969 | Grundberg | |
| 3,456,554 | A | | 7/1969 | Goodwin | |
| 3,496,829 | A | * | 2/1970 | Heuser et al. | 89/135 |
| 3,617,813 | A | * | 11/1971 | Everest | 361/250 |
| 3,677,135 | A | | 7/1972 | Haug, Jr. | |
| 3,700,971 | A | * | 10/1972 | Everest et al. | 361/250 |
| 3,748,960 | A | | 7/1973 | Mindel | |
| 3,803,974 | A | * | 4/1974 | Everest et al. | 89/1.56 |
| 3,854,231 | A | * | 12/1974 | Broyles | 42/84 |
| 3,967,530 | A | * | 7/1976 | Vorgrimler et al. | 89/135 |
| 4,510,844 | A | | 4/1985 | Fritz et al. | |
| 4,624,641 | A | * | 11/1986 | Gallagher | 434/21 |
| 5,004,423 | A | * | 4/1991 | Bertrams | 434/22 |
| 6,951,071 | B1 | | 10/2005 | Acosta et al. | |
| 6,976,416 | B2 | | 12/2005 | Ealovega | |
| 2002/0179077 | A1 | | 12/2002 | Juan | |
| 2006/0283386 | A1 | * | 12/2006 | Alexander et al. | 118/620 |

OTHER PUBLICATIONS

Scott Gourley, "Metal Storm Weapons", Published in the Sep. 2001 issue, Popular Mechanics, "Http://www. popularmechanics.com/technology/military_law/1281426.html?nav=hpPrint&do=Print", pp. 1-2.

* cited by examiner

*Primary Examiner* — Troy Chambers
(74) *Attorney, Agent, or Firm* — Young & Thompson

(57) ABSTRACT

An electronic apparatus for controlling a firing rate of an automatic firing weapon having an actuator operating a trigger mechanism of the weapon, the weapon exhibiting a natural free-running firing rate when triggered. An output driver element provides a drive signal for the actuator, a first single pulse generator element having a single pulse output coupled to an input of the driver element and generating a single pulse of a duration shorter than a time period of the natural free-running firing rate in response to a single pulse generator element input, and a pulse train generator element having a single pulse output coupled to an input of the first single pulse generator element and providing the first single pulse generator element a train of pulses spaced in time a spacing period exceeding the time period of the natural free-running firing rate in response to a pulse train generator element input.

3 Claims, 3 Drawing Sheets

ELECTRONIC FIRING RATE CONTROLLER FOR REMOTE OPERATION OF AN AUTOMATIC FIRING WEAPON

BACKGROUND OF THE INVENTION

The present invention relates to the field of weapons capable of firing a large series of rounds within a short period of time, herein referred to as an automatic weapon or a semi-automatic weapon, and in particular a rate controller for operating and controlling from a remote location the weapon and the rate at which rounds are fired by the weapon.

More particular, the invention relates to a rate controller for controlling from a remote location the rate at which rounds are fired by the weapon employing a solenoid operated trigger mechanism.

Crew served automatic weapons are primarily intended for suppression fire and as such, the dispersion can be fairly high. This is partly due to the weapon itself, but mostly due to the weapon mount and the soldier firing the weapon. When mounted on a remotely controlled weapon station, the weapon is mounted in a significantly more stable environment and the dispersion of the weapon itself becomes significant.

The firing rate of recoil- or gas-operated weapons is determined by the dynamics of the weapon itself, as well as external factors such as ammunition and weapon mount, and there will be a natural spread of the firing rate due to variations in the above parameters. The firing rate can be reduced by firing single shots in a controlled sequence with a fixed frequency.

Related art is disclosed in U.S. Pat. No. 3,748,960, U.S. Pat. No. 3,451,307, U.S. Pat. No. 6,976,416, US2002/0179077, and U.S. Pat. No. 4,510,844.

SUMMARY OF THE INVENTION

Some of the objects of the invention are to maintain suppression fire using less ammunition, to achieve better precision (reduce inherent spread), to extend the time period between barrel replacement, to extend the time period between filling of ammunition, to achieve semi automatic operation of a fully automatic weapon, preferably without making any significant modifications to the weapon exploiting the present invention.

The invention is arranged to reduce the firing rate, such as e.g. by firing a number of single shots in a sequence with variable frequency.

The objects mentioned above and other objects are achieved by the present invention which provides an apparatus for remote operation and remote firing control of an automatic firearm, the features of which apparatus are recited in the accompanying claims.

BRIEF DESCRIPTION OF THE DRAWINGS

In the following, the invention will be explained in more detail, and also with reference to the accompanying drawing figures, wherein.

DESCRIPTION OF PREFERRED EMBODIMENTS

An exemplary embodiment of the present invention which is adapted to a firearm with a solenoid operated trigger mechanism includes a transient diode, which is useful in an application of a sequence with pulsing of a voltage to the solenoid.

The apparatus of the invention is preferably adapted to control the firing points by controlling the pulse duration.

A firearm including the present invention is operational to fire several single shots in a sequence to "simulate" a weapon having a lower firing rate, which, however, is adapted such that one is enabled to fire only a single shot in a controlled fashion (single shot), alternatively that by single shot it is operable to release remote trigger between each shot. Other operational modes include to set the weapon to an auto rate, or in operation at a reduced rate. This is a variant of the present invention contemplated achieved by adapting the firing rate control apparatus of the invention to generate a control pulse train of pulses each corresponding to a single shot pulse, such as e.g. illustrated by its way of example in FIG. 2.

Advantageously, the firing rate is adjustable by way of a control input to the firing rate controller FRC, thus allowing an adaptation to the best dynamics of the weapon and any possible damping mechanism, whereby an optimum firing rate versus dispersion is achieved.

The apparatus of the invention is advantageously adapted to control the instant of firing such that it represents single shot firing or a controlled, reduced firing rate in a fully automatic man operated weapon with a remotely controlled triggering arrangement, advantageously in conjunction with a weapon using a solenoid. An example of a fully automatic man operated weapon with a remotely controlled triggering arrangement is a so-called "weapon station", such as e.g. the remote weapon station (RWS) named "PROTECTOR", manufactured by Kongsberg Defense & Aerospace AS.

Figure 1:
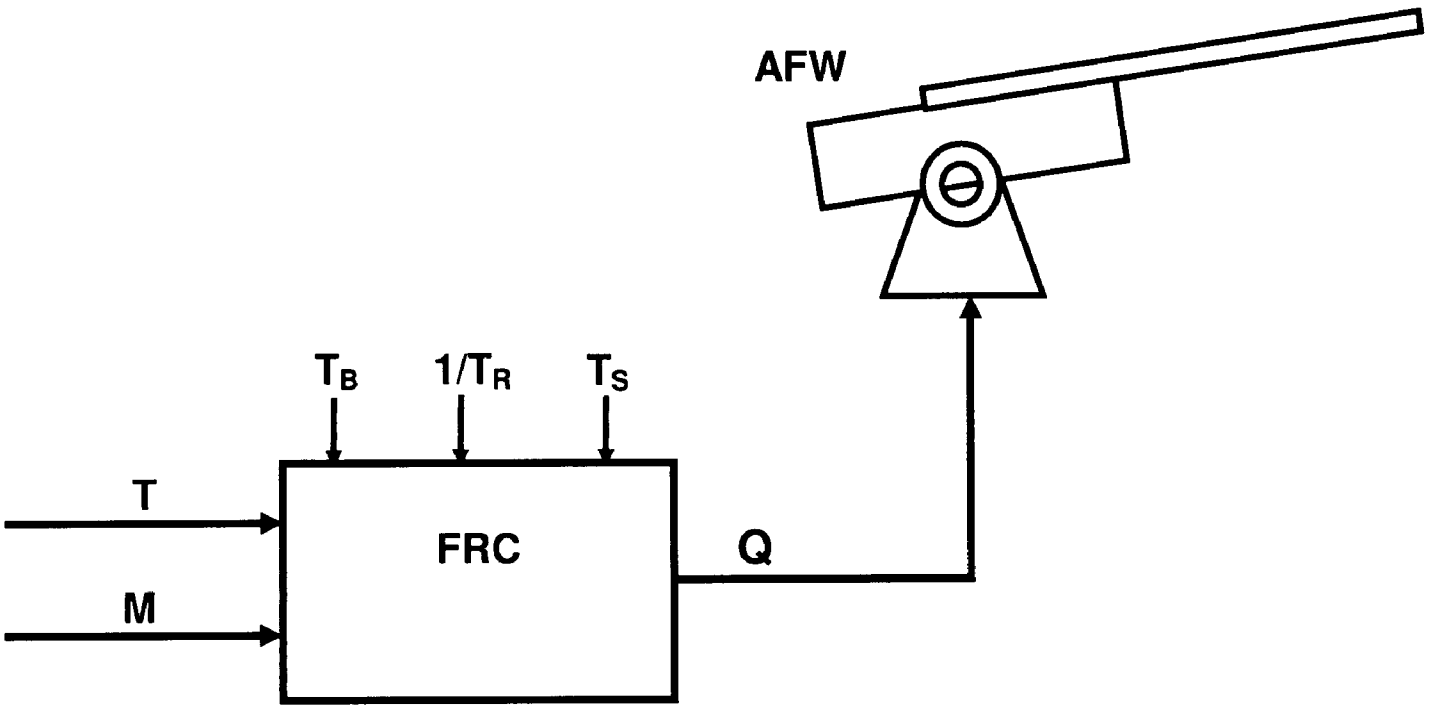
FIG. 1 is a schematic representation of an embodiment example of a firearm for automatic operation in connection with a firing rate control apparatus according to the invention.

For a further detailed explanation of the firing rate controller FRC apparatus of the invention by way of example, reference is first made to the accompanying FIG. 1.

In the well known RWS, such as the PROTECTOR RWS referred to above, remote firing of the automatic firing weapon AFW is controlled by a trigger switch, typically a switch at the operator location. Upon activation of the switch, a current is allowed to flow in the electrical firing circuit that energizes a solenoid which, in turn mechanically operates the trigger mechanism of the weapon. The weapon typically is provided with a selector means, typically in the form of a selector lever, for selecting one of a single shot operation or a fully automatic operation. Accordingly, to select any of the two aforementioned operational modes from a remote location, a further selector actuator is required to allow operation of the mode selector lever of the weapon.

According to the present invention, a further operational mode is provided which corresponds to the single shot operational mode also for the weapon when set to operate in the fully automatic mode. As an example of a solution adapted to provide the further operational mode, an electronic relay is provided in series with the trigger switch to control a single shot also at a time when the weapon when set to operate in the fully automatic mode. The electronic relay is a time relay which lets the current for the solenoid actuating the trigger mechanism of the weapon to flow for only a fixed time, allowing enough time for the solenoid to energize, and for the firing mechanism to activate to fire the first shot of what could otherwise be an automatic series of firings, and also enough time for the solenoid to de-energize and retract, thereby disabling firing of the weapon, before the second shot of the automatic series of firings is ready to fire. The solenoid (and any additional mechanism) are adapted to operate quickly in order to get a precise control of the weapon. Preferably, only one shot is fired irrespective of weapon, supply voltage, environmental changes and type of ammunition.

By repeating the above sequence with a settling time in between each shot, allowing for the weapon and mount to stabilize, a controlled firing rate can be achieved. Various firing rates are advantageously made available for the operator to select from.

Furthermore, the firing rate controller apparatus of the invention is advantageously designed such that no modifications are required on the weapon itself for it to operate as described herein.

The example of a firing rate controller according to the present invention illustrated generally in FIG. 1 includes at least a firing trigger input T, a mode select input M, and an output Q for providing a signal to actuate the weapon trigger actuator. The functions provided by operation of the T and M inputs are generally as explained above.

In an advantageous embodiment of the FRC of the present invention, additional inputs are provided, such as a rate control input ($1/T_R$), and a solenoid pulse control input ($T_S$). By the rate control input ($1/T_R$), which has effect the operator is allowed to control the rate of the signal to actuate the weapon trigger actuator for releasing a shot from the weapon in the single shot mode of operation of the weapon itself. When the fully automatic mode has been selected, the $1/T_R$ is disregarded.

Figure 2:
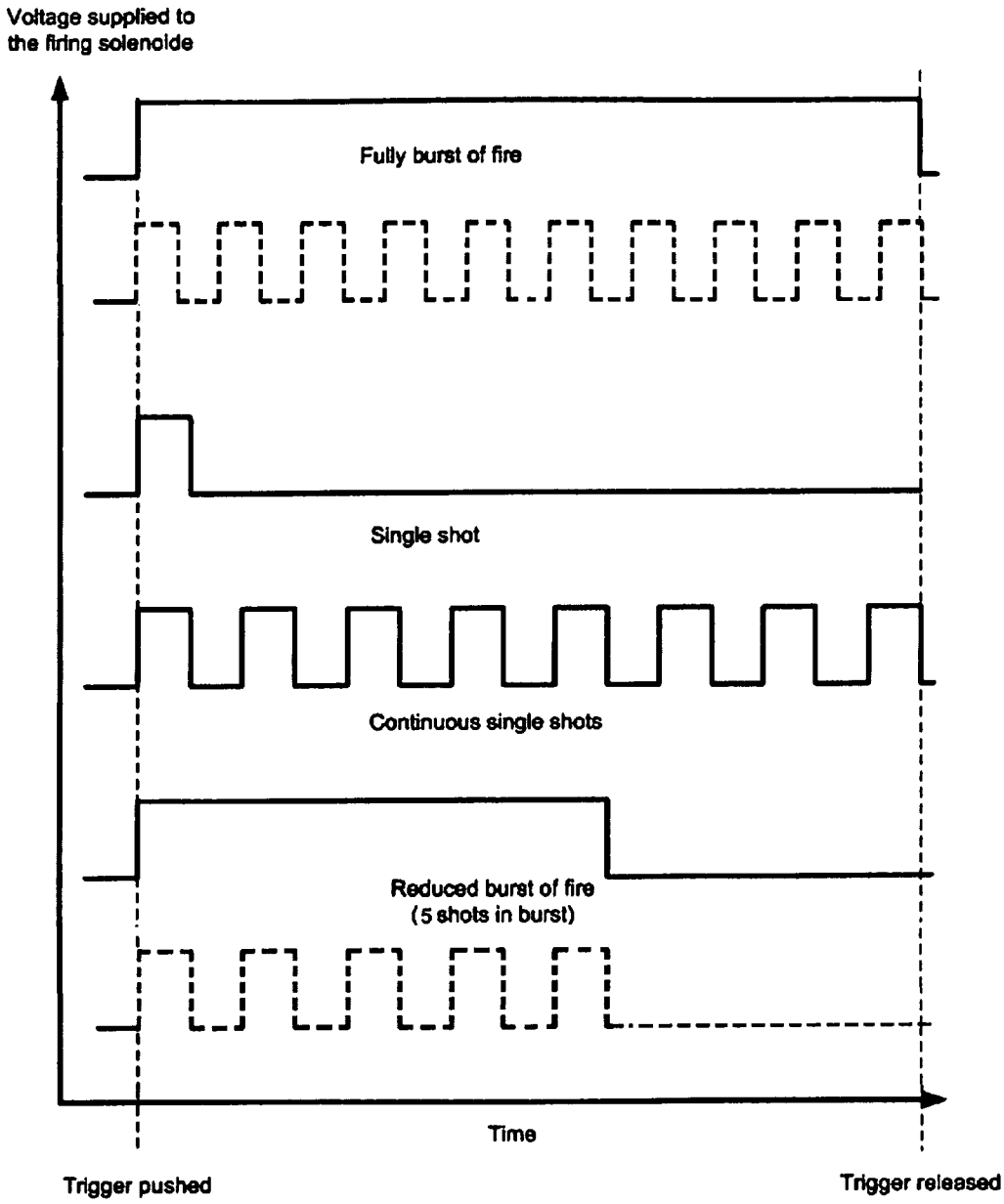
FIG. 2 is a graph illustrating examples of firing drive signals in an example of an embodiment of the present invention, and actual firings of a weapon.

In the examples illustrated in FIG. 2, four examples of outputs Q are represented by respective plots of a voltage supplied to a trigger solenoid at the weapon. In the first plot from the top drawn in solid line, the voltage is represented by a single pulse output Q of a time duration $T_T$ corresponding to the time the trigger switch is closed and which significantly exceeds the time interval between shots $T_F$ of the natural fully automatic free-running firing rate of the weapon, resulting in the firing of the actual burst series of ten rounds fired by the weapon as illustrated by the dotted line plot immediately below. That dotted line plot of the actual series of ten rounds also illustrates the time period $T_F$ between shots released by the natural fully automatic free-running firing rate of the weapon. In the second plot from the top being drawn in solid line, the voltage is represented by a single pulse output Q of a time duration $T_S$ that is shorter than the time interval $T_F$ between shots fired by the natural fully automatic firing rate of the weapon, resulting in the releasing of only a single shot from the weapon. In the third plot from the top being drawn in solid line, the voltage is represented by a series of eight single pulses output Q, where each single pulse of a time duration $T_S$ is repeated at intervals of duration $T_R$ which is shorter than the time interval $T_F$ between shots fired by the natural fully automatic free-running firing rate of the weapon, resulting in the releasing of a series of eight shots from the weapon at a reduced rate that is 8/10 of the natural fully automatic free-running firing rate of the weapon in this example. In the fourth plot from the top being drawn in solid line, the voltage is represented by a single pulse output Q of a time duration $T_B$ which still significantly exceeds the time interval between $T_F$ shots the natural fully automatic firing rate of the weapon but is shorter than the duration of the pulse illustrated by the top graph, resulting in the firing of the reduced actual burst series of five rounds fired by the weapon illustrated by the dotted line plot immediately below.

Figure 3:
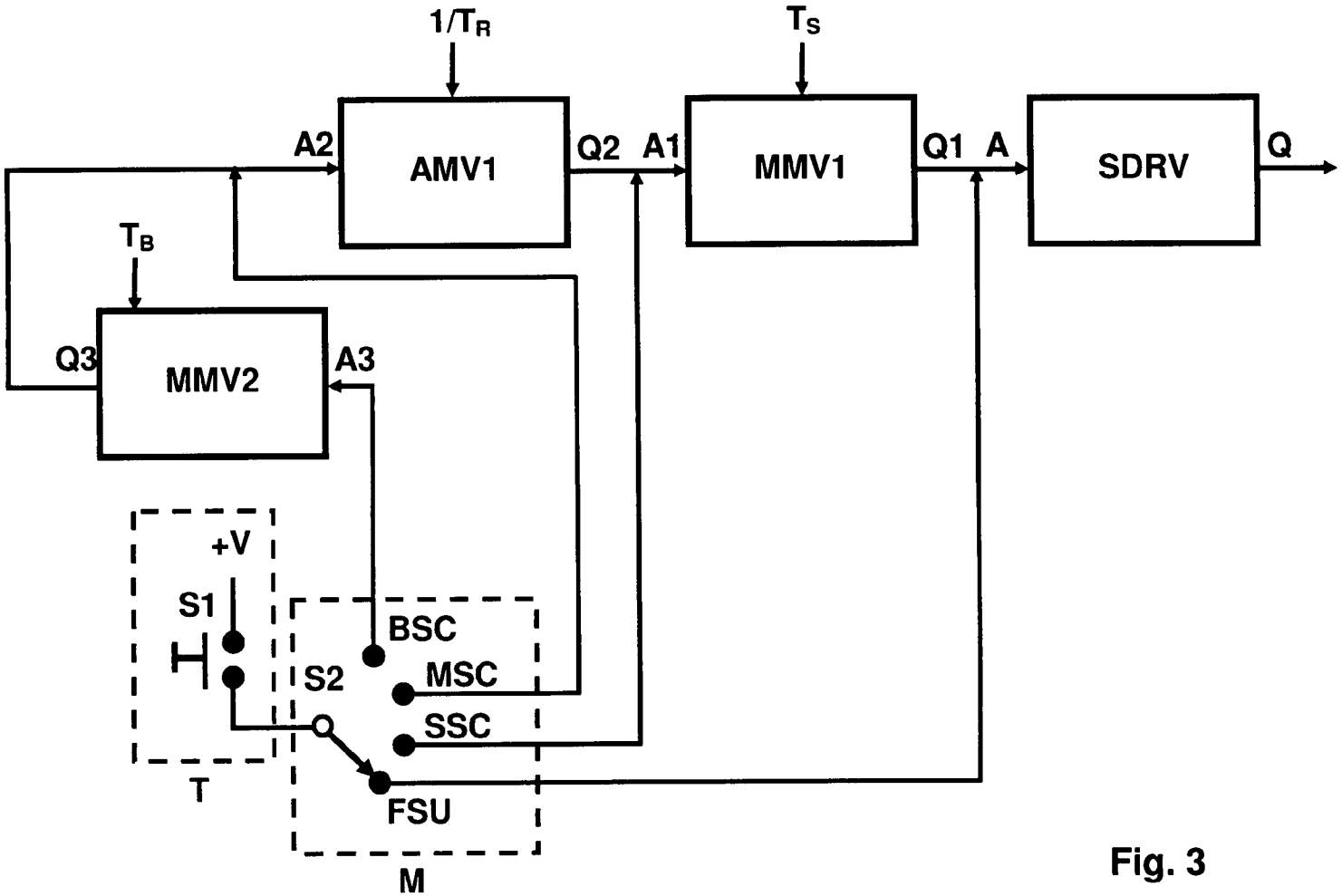
FIG. 3 is a block schematic illustration of an embodiment example of an electronic firing rate control apparatus according to the invention.

In FIG. 3, an embodiment example of a firing rate controller circuit is illustrated in a block schematic representation. The circuit example includes, connected in series, a solenoid driver SDRV (e.g., output driver means) providing the pulse output Q and receiving an input from a first monostable multivibrator MMV1 (e.g., first single pulse generator means) receiving an input from a first astable multivibrator AMV1 (e.g., pulse train generator means) receiving an input from a second monostable multivibrator MMV2 (e.g., second single pulse generator means), and a mode control selector M and a trigger switch T providing inputs to any the SDRV, MMV1, AMV1, or MMV2. Advantageously, any of MMV1 and MMV2 is a non-triggerable type of monostable multivibrator.

Accordingly, SDRV is driven by an output Q1 provided by the MMV1, which in turn is driven by an output Q2 provided by the AMV1, which in turn is driven by output Q3 provided by the MMV2. Any of the SDRV, MMV1, AMV1 and MMV2 are further adapted to be driven each by respective a respective one of mode selector M outputs FSU, SSC, MSC and BSC provided by M and in accordance with an operation of the trigger switch T.

Thus, in response to closing the trigger switch T with the mode selector a) set to output FSU (free-running shot uncontrolled), DRV provides an output Q for as long as T is closed, b) set to output SSC (single shot controlled), DRV provides an output Q of duration Ts, c) set to output MSC (multi shot controlled), DRV provides an output Q of a series of pulses of duration Ts at a rate 1/Tr for as long as T is closed, and d) set to BSC (burst shot controlled), DRV provides an output Q of duration Tb for as long as T is closed.

The embodiment example of a firing rate controller circuit illustrated in a block schematic representation in FIG. 3 lends itself readily to be made in a modular construction. As an example, any of MMV2 or AMV1 could be omitted to provide a simpler controller with fewer functions, then AMV1 could be introduced subsequently to provide the reduced rate series function, and then, MMV2 could be introduced subsequently to provide the limited burst at reduced rate series function.

The circuit example includes a solenoid driver SDRV, advantageously designed as a module in the FRC of the invention, that could be replaced by a different type of driver module in case the weapon trigger mechanism actuator is not a solenoid type actuator. Accordingly, it is contemplated to adapt the FRC of the invention to include a driver module for a pneumatic or hydraulic actuator at the AFW to allow remote firing control of the weapon without relying on a transmission of an electrical type of signal from the driver to the actuator at the weapon station.

It is contemplated to embody the FRC of the invention using a programmable controller device, such as for example a programmable microcontroller or the like, to create therein any or all of the functional elements of the SDRV, MMV1, AMV, and MMV2.

The invention claimed is:

1. An electronic apparatus for controlling a firing rate of an automatic firing weapon having an actuator adapted to operate a trigger mechanism of said weapon, said weapon exhibiting a natural free-running firing rate when held triggered, said apparatus comprising an output driver means (SDRV) adapted to provide a drive signal (Q) for said actuator, a first single pulse generator means (MMV1) having a single pulse output (Q1) coupled to an input (A) of the output driver means and adapted to generate a single pulse of a duration shorter than a time period of said natural free-running firing rate in response to a single pulse generator means input ($T_S$), and a pulse train generator means (AMV1) having a single pulse output (Q2) coupled to an input (A1) of said first single pulse generator means and adapted to provide to the first single pulse generator means a train of pulses spaced in time a spacing period exceeding said time period of said natural free-running firing rate in response to a pulse train generator means input ($1/T_R$).

2. The electronic apparatus of claim 1, further comprising a trigger switch (T) adapted to provide to a mode selector (M) a trigger signal in response to an operation of said trigger switch, said mode selector adapted to couple said trigger signal to first (FSU), second (SSC) and third (MSC) mode selector outputs, said first mode selector output coupled to said input (A) of the output driver means, said second mode selector output coupled to said input (A1) of the first single pulse generator means, and said third mode selector output coupled to an input (A2) of the pulse train generator means to provide said pulse train generator means input.

3. The electronic apparatus of claim 2, further comprising a second single pulse generator means (MMV2) having a single pulse output (Q3) coupled to the input (A2) of the pulse train generator means and adapted to generate a single pulse of a duration longer than said spacing period of coinciding pulses of said train of pulses, and said mode selector further adapted to couple said trigger signal input to a fourth (BSC) mode selector output coupled to a control input (A3) of said second single pulse generator means.

* * * * *